US005110080A

United States Patent [19]

Rieman

[11] Patent Number: 5,110,080

[45] Date of Patent: May 5, 1992

[54] HOLDING STRIP FOR SUSPENSION BARS

[75] Inventor: Martin Rieman, Eslov, Sweden

[73] Assignee: Sparring Elfa Aktiebolag, Vastervik, Sweden

[21] Appl. No.: 543,731

[22] PCT Filed: Feb. 10, 1989

[86] PCT No.: PCT/SE89/00058

§ 371 Date: Aug. 2, 1990

§ 102(e) Date: Aug. 2, 1990

[87] PCT Pub. No.: WO89/07409

PCT Pub. Date: Aug. 24, 1989

[30] Foreign Application Priority Data

Feb. 10, 1988 [SE] Sweden ..... 8800441

[51] Int. Cl.[5] ..... E04G 3/00

[52] U.S. Cl. ..... 248/225.1; 248/225.2; 211/94

[58] Field of Search ..... 248/225.1, 222.2, 220.2, 248/243, 225.2; 211/87, 90, 94

[56] References Cited

U.S. PATENT DOCUMENTS

| | | | |
|---|---|---|---|
| 754,503 | 3/1904 | Rubicam et al. | 211/87 X |
| 1,055,201 | 3/1913 | Mason | 248/222.2 X |
| 2,754,974 | 7/1956 | Larson | 211/87 |
| 4,094,415 | 6/1978 | Larson | 211/87 X |
| 4,373,693 | 2/1983 | Greenberger | 248/225.1 X |
| 4,602,756 | 7/1986 | Chatfield | 248/225.1 |
| 4,693,381 | 9/1987 | Lodge | 248/225.1 X |
| 4,807,764 | 2/1989 | Bellin | 211/94 |

FOREIGN PATENT DOCUMENTS

| | | | |
|---|---|---|---|
| 924232 | 1/1955 | Fed. Rep. of Germany | 211/94 |

*Primary Examiner*—Alvin C. Chin-Shue
*Attorney, Agent, or Firm*—Nilles & Nilles

[57] ABSTRACT

A holding strip for suspension bars, which is used to suspend various objects, e.g. brackets and shelf units etc. received on the brackets. The holding strip is designed to be screwed or in another fashion fastened, in a horizontal position, to a wall or similar surface and designed with a rear face, which is to be in contact with the wall, a lower holding edge which is bent obliquely upwardly and inwardly towards the room and designed to cooperate with a corresponding mounting slot of a suspension bar, as well as an upper stop edge which is bent obliquely downwardly and inwardly towards the room and positioned at such a distance above the upper end of the holding edge and adapted to the suspension bar in such a way that a suspension bar which is received on the holding edge is prevented from being lifted and removed from the holding edge because the upper side of the suspension bar will abut the lower end of the stop edge. In order to receive and remove a suspension bar the top edge has, in one or several areas, a recess up to the rear face, and adjustment grooves for the suspension bar.

7 Claims, 1 Drawing Sheet

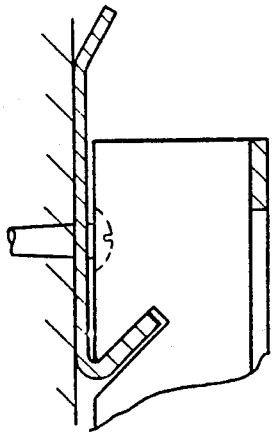
FIG. 1
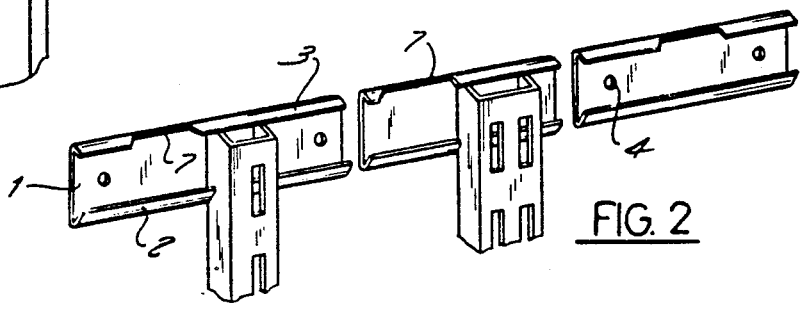
FIG. 2
FIG. 3
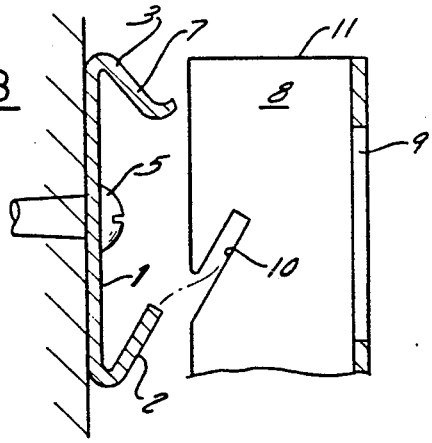
FIG. 4
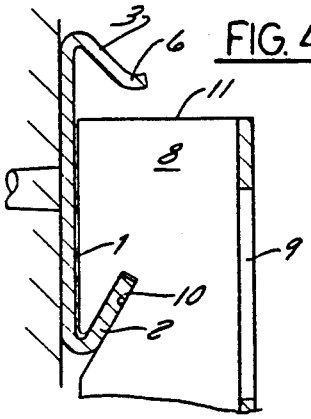
FIG. 5
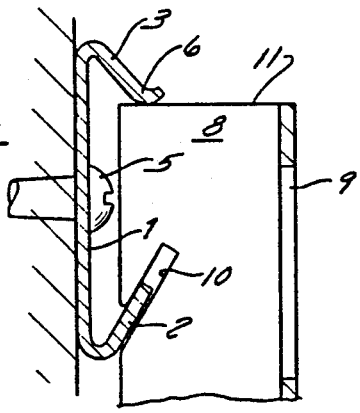
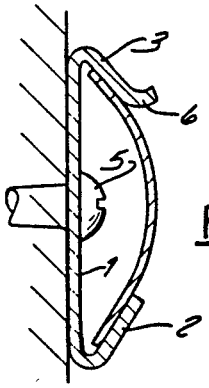
FIG. 6

HOLDING STRIP FOR SUSPENSION BARS

BACKGROUND OF THE INVENTION

The present invention relates to a holding strip for suspension bars, which is known and used to suspend various objects, e.g. brackets and shelf units etc, carried by said brackets, the holding strip being designed to be screwed on or in another fashion be fastened, in a horizontal position, to e.g. a wall and designed with a rear face for contacting said wall and a lower holding edge bent obliquely upwardly and inwardly towards the room and designed to hold a suspension bar, which latter to this end is designed with a slot, designed in a corresponding manner, with which slot said holding edge can engage. When the suspension bar is suspended it is lowered with its suspension slot over the holding edge of the holding strip. Some holding bars are also provided with an upper edge, which is bent obliquely upwardly and inwardly towards the room and which can form a kind of shade ledge or abut the ceiling. A holding strip having a suspension bar of the known type described above is shown in FIG. 1.

This known type of holding strip has a serious drawback, since the suspension bar can be unhooked from the holding edge of the holding strip, if it is lifted upwardly so far that said slot is disengaged from said holding edge, which may result in that an entire shelf set or the like gets loose and tumbles.

SUMMARY OF THE INVENTION

The object of the present invention is to solve this problem and suggest a new and improved holding strip, which is designed in such a manner that a suspension bar adapted to said holding strip cannot be loosened inadvertently, because said suspension bar is in its normal mounting position secured against at least such large lifting movements that would loosen it from the holding edge of the holding strip, while it in one or several positions yet can be adapted onto the holding edge of the holding strip and loosened from it respectively.

Said suspension bar comprises, according to the present invention, a rear face in a known fashion used to screw the suspension bar to a wall or the like, and a lower holding edge bent obliquely upwardly and inwardly towards the room, on which holding edge the suspension bar, provided with a obliquely upwardly and inwardly directed mounting slot, can be hooked, and the novel feature of the invention is that said suspension bar is designed with an upper edge, which is bent obliquely downwardly and inwardly towards the room and is used as a stop edge, which prevents a removing of said suspension bar from the holding edge of said holding strip, said upper edge of said holding strip in one or several areas being cut away up to said rear face a distance which corresponds to the width of said suspension bar, thus allowing the latter to be hooked downwardly over said holding edge solely in this or these areas and subsequently be pushed in a lateral direction, sliding with its suspension slot along said holding edge into the desired position on said holding strip. An optional number of suspension bars can in this manner be adapted to just one holding strip.

Additional characterizing features and advantages of the present invention will be set forth in the following detailed description, reference being made to the accompanying drawings.

BRIEF DESCRIPTION OF THE DRAWINGS

In FIG. 1 in the drawings a holding strip of a type already known is shown. In FIG. 2 a holding strip according to the present invention having two different types of suspension bars in mounted positions is shown in a perspective view. FIG. 3 shows a cross-section of the bar according to the invention with a suspension strip ready to be mounted. FIG. 4 shows in a corresponding way the suspension bar in a completely mounted and loaded position on the holding strip. FIG. 5 shows also in the same way the suspension bar in a situation when it is being pushed past a round head of a screw, by means of which the holding strip has been screwed onto the wall; and FIG. 6 finally shows a holding strip provided with a cover or barrier strip according to the present invention.

DESCRIPTION OF THE PREFERRED EMBODIMENT

The holding strip comprises a longitudinal bar, which can be produced in endless lengths and be cut to the desired lengths and comprises a rear face 1, a holding edge 2 bent upwardly from the lower edge of said rear face and designed to hold a suspension bar and a stop edge 3 bent downwardly from said rear face and designed to prevent an inadvertent loosening of a mounted suspension bar.

Said rear face 1 is even and designed to be screwed or in an another way fastened to a wall or another vertical surface and to this end it is provided with screw holes 4 for screws 5, suitably having round heads, in order to obtain a better strength.

Holding edge 2 is bent upwardly and inwardly towards the room at a certain angle, e.g. an angle of 30°, in relation to a vertical plane, e.g. the wall.

Said stop edge 3 is bent from the upper edge of rear face 1 obliquely downwardly and inwardly towards the room, and thus it forms an acute angle with the wall or a vertical plane, e.g. an angle of about 30°. This angle is less critical. The outer end of the stop edge suitably is bent upwards and thus it forms a horizontal plane or a curve, against which a suspension bar abuts and is stopped, if the holding bar is lifted upwards. In one or several areas the stop edge has a recess up to rear face 1, one or several adjustment grooves 7 being formed having such a length that a suspension bar can be introduced in it and subsequently be lowered, said suspension slot engaging holding edge 2 of the strip.

Suspension bar 8 is known per se and comprises an essentially U-shaped profile, which along its web portion is provided with one or two series of slots 9, designed to receive shelf brackets (not shown) or the like and which adjacent its upper edge is designed with a mounting slot 10, which extends into the legs of the U-profile from those edges of said legs which abut said wall and obliquely upwardly and inwardly towards the room, said mounting slot having the same direction as the holding edge and essentially the same length. The suspension bar is adapted to the holding strip in such a way that the distance between the inner and upper end of mounting slot 10 and upper edge 11 of suspension bar 8 is not larger than the free vertical distance between holding edge 2 and stop edge 3.

However, in a preferred embodiment of the invention the distance between the inner and upper end of mounting slot 10 and upper side 11 of suspension bar 8 is somewhat smaller than the free distance between holding edge 2 and stop edge 3 of the holding strip, and in this way suspension bar can be lifted such a distance, obliquely upwardly and inwardly towards the room, that it can be pushed past the round head 5 of a screw without disengaging it from holding edge 2 of the holding strip, which is shown in FIG. 4.

The mounting of a suspension bar is accomplished by moving the bar towards the holding strip at an adjustment groove 7 and lowering it in order to make holding edge 2 slide into mounting slot 10 of the suspension bar, subsequent to which the suspension bar is moved in a lateral direction from adjustment groove 7 to the desired position, where it will be secured against a loosening from the holding strip by means of stop edge 3 of the holding strip.

A suspension bar can be lifted up and released in the opposite manner, provided the bar is moved to an adjustment groove 7.

In order to cover the front of the used holding strip or a portion of it a cover strip 12 can be introduced into the groove between holding edge 2 and stop edge 3, the covering strip together with the holding strip forming a neat unit. Also, suitable lengths of the cover strip can be used to prevent suspension bars from moving in a lateral direction or in relation to a side wall, such pieces of material being introduced between holding edge 2 and stop edge 3 and engaging the outer sides of the legs of said suspension bar.

What is claimed is:

1. A horizontal holding strip for mounting on a wall or corresponding surface vertical suspension bars (8), said vertical suspension bars used to suspend brackets and shelf units received by said brackets, said horizontal holding strip comprising:

a rear face (1) provided with means (4) for fastening said horizontal holding strip to said wall;

a lower holding edge (2) bent obliquely upward from the lower edge of said rear face and outward from said wall and designed to cooperate with a corresponding mounting slot (10) of said vertical suspension bar (8);

an upper stop edge (3) bent obliquely downward from the upper edge of said rear face and outward from said wall with the lower end (6) of the stop edge bent outwardly and placed at such a distance above the upper end of said lower holding edge (2) and adapted in such a way that a vertical suspension bar received on said lower holding edge (2) is prevented from being removed from said lower holding edge (2), since the upper side of said suspension bar (8) abuts and is stopped by the lower end of said stop edge (3); and said stop edge (3) of said holding strip has at least one recess (7) up to said rear face (1), the length of which substantially corresponds to the width of said suspension bar and into which a suspension bar can be introduced and lowered such that said mounting slot (10) of said vertical suspension bar (8) surrounds said holding edge (2), and so that said vertical suspension bar can be lifted up and removed from said holding edge (2) of said holding strip, respectively.

2. The horizontal holding strip according to claim 1, characterized in that the distance between the upper end of said holding edge (2) of said holding strip and the lower end of said stop edge (3) is somewhat larger than the distance between the upper end of said mounting slot (10) of said suspension bar (8) and the upper edge (11) of said suspension bar, the result being that a suspension bar, in its mounted condition and while maintaining an engagement with said holding edge (2), can be lifted somewhat and moved in a lateral direction and pushed preferably past a round head of a screw, but said distance being not so large that said suspension bar can be released from said holding edge (2) of said holding strip.

3. A holding strip according to claim 1, characterized in that said holding edge (2) of said holding strip as well as the corresponding mounting slot (10) of said suspension bar (8) form an angle of about 30° with the wall plane or a vertical plane.

4. A holding strip according to claim 3, characterized in that the stop edge of said holding strip also forms an angle of about 30° with the wall plane or a vertical plane.

5. A holding strip according to claim 1, characterized in that it includes a cover strip (12), designed to be introduced in an outwardly convex arcuate shape between said holding edge (2) and said stop edge (3).

6. A holding strip according to claim 5, characterized in that said cover strip (12) also can be used, in suitable lengths, to prevent suspension bars (8) from being pushed in a lateral direction in relation to each other or in relation to a wall or the like.

7. A device for mounting support brackets and shelves on a wall surface comprising:

a horizontal holding strip, having a rear face fastenable against the wall surface, formed with a projecting hanger flange bent obliquely upward from the lower edge of the rear face and outward from the wall surface, and formed with an upper stop flange bent obliquely downward from the upper edge of the rear face and outward from the wall surface;

a vertical hanger bar formed with an obliquely upward extending hanger slot engageable over the hanger flange of the holding strip;

at least one recess in the stop flange of the holding strip, with the recess having a length corresponding to the width of the vertical hanger bar, into which a vertical hanger bar can be introduced and lowered in such a manner that the hanger slot of the vertical hanger bar surrounds the hanger flange of the holding strip, and from which the vertical hanger bar can be lifted up and removed from the hanger flange of the holding strip, respectively;

the distance between the upper end of the hanger flange and the lower end of the stop flange of the holding strip being somewhat larger than the distance between the upper end of the hanger slot and the upper side of the vertical hanger bar so that the vertical hanger bar in its mounted condition and while maintaining engagement over the hanger flange can be lifted somewhat and moved in a lateral direction; and the distance between the upper end of the hanger flange and the lower edge of the stop flange of the holding strip being somewhat less than the distance between the lower end of the hanger slot and the upper side of the vertical hanger bar so that upon upward movement of the vertical hanger bar in its mounted condition and while maintaining engagement over the hanger flange the upper side of the vertical hanger bar abuts and is stopped by the lower edge of the stop flange.

* * * * *